US006260227B1

(12) United States Patent
Fulop et al.

(10) Patent No.: US 6,260,227 B1
(45) Date of Patent: Jul. 17, 2001

(54) ORTHODONTIC TOOTHBRUSH

(76) Inventors: Jacqueline Fulop, 280 Old Willets Path, Smithtown, NY (US) 11787; Sonia Mota, 900 Surrey Dr., East Meadow, NY (US) 11554; Julia Trigg, 207 Albany Ave., Lindenhurst, NY (US) 11757

( * ) Notice: Subject to any disclaimer, the term of this patent is extended or adjusted under 35 U.S.C. 154(b) by 0 days.

(21) Appl. No.: 09/655,015

(22) Filed: Sep. 5, 2000

Related U.S. Application Data

(63) Continuation-in-part of application No. 09/224,468, filed on Dec. 31, 1998, now abandoned.

(51) Int. Cl.[7] ..... A46B 9/04

(52) U.S. Cl. ..... 15/167.1; 15/172; 15/176.1; 15/207.2; 15/DIG. 5

(58) Field of Search ..... 15/167.1, 172, 15/207.2, 176.1, 176.6, DIG. 5; D4/104

(56) References Cited

U.S. PATENT DOCUMENTS

| | | |
|---|---|---|
| D. 305,386 | 1/1990 | Ram et al. . |
| 1,018,927 | 2/1912 | Sarrazin . |
| 2,819,482 | 1/1958 | Applegate . |
| 3,722,020 | 3/1973 | Haije . |
| 3,978,852 | 9/1976 | Annoni . |
| 4,033,008 | 7/1977 | Warren et al. . |
| 4,240,452 | 12/1980 | Jean . |
| 4,382,309 | 5/1983 | Collis . |
| 4,493,125 | 1/1985 | Collis . |
| 4,519,111 | 5/1985 | Cavazza . |
| 4,670,931 | 6/1987 | Abbassi . |
| 4,694,844 | 9/1987 | Berl et al. . |
| 4,706,322 | 11/1987 | Nicholas . |
| 4,731,896 | 3/1988 | DeLa Tour . |
| 4,954,305 | 9/1990 | Weihrauch . |
| 4,979,782 | 12/1990 | Weihrauch . |
| 5,119,522 | 6/1992 | Potts . |
| 5,184,368 | 2/1993 | Holland . |
| 5,201,092 | 4/1993 | Colson . |
| 5,230,118 | 7/1993 | Chamma . |
| 5,325,560 | 7/1994 | Pavone . |
| 5,335,389 | 8/1994 | Curtis et al. . |
| 5,511,275 | 4/1996 | Volpenhein et al. . |
| 5,537,708 | 7/1996 | Luposello . |
| 5,628,082 | 5/1997 | Moskovich . |
| 5,742,972 | 4/1998 | Bredall et al. . |

(List continued on next page.)

FOREIGN PATENT DOCUMENTS

WO9801055A 7/1996 (WO) .

*Primary Examiner*—Terrence R. Till
(74) *Attorney, Agent, or Firm*—Alfred M. Walker

(57) ABSTRACT

An orthodontic toothbrush cleans braces and teeth effectively, including braces which have brackets protruding from tooth surfaces, wherein the brackets are connected by a spanning archwire. The orthodontic toothbrush has a longitudinally extending handle attached to a teeth cleaning head with bristles extending upward therefrom. The bristle head includes rows of bristles, which contact and clean both the orthodontic appliances attached to the surfaces of the teeth and underlying teeth at the same time because of the several different bristle heights. The shortest group of bristles is in the middle of all the bristle rows. The height of these shortest bristles represent an average protrusive depth of the thickness of a typical bracket or band protruding from a tooth's surface. Adjacent to the shortest heightened bristles is an intermediate row, bilaterally, used to assist in removing and cleaning food debris and bacteria harboring on the incisal/occlusal (top) and gingival (bottom) portions of a tooth's crown and orthodontic bracket or band. Adjacent to the intermediate heighted bristles are rows of tuft of pairs of taller bristles that split apart, bilaterally to reach between surfaces. The tallest bristles are located at the distal end of the toothbrush head.

16 Claims, 20 Drawing Sheets

U.S. PATENT DOCUMENTS

| | | |
|---|---|---|
| 5,857,471 | 1/1999 | Harada . |
| 5,862,559 | 1/1999 | Hunter . |
| 5,881,425 | 3/1999 | Hudson . |
| 5,926,897 | 7/1999 | Volpenhei . |
| 6,006,394 | 12/1999 | Bredall . |
| 6,041,468 | 3/2000 | Chen et al. . |
| 6,065,176 | 5/2000 | Watanabe . |
| 6,108,851 | 8/2000 | Bredall . |
| 6,131,228 | 10/2000 | Chen et al. . |

FIG.3B
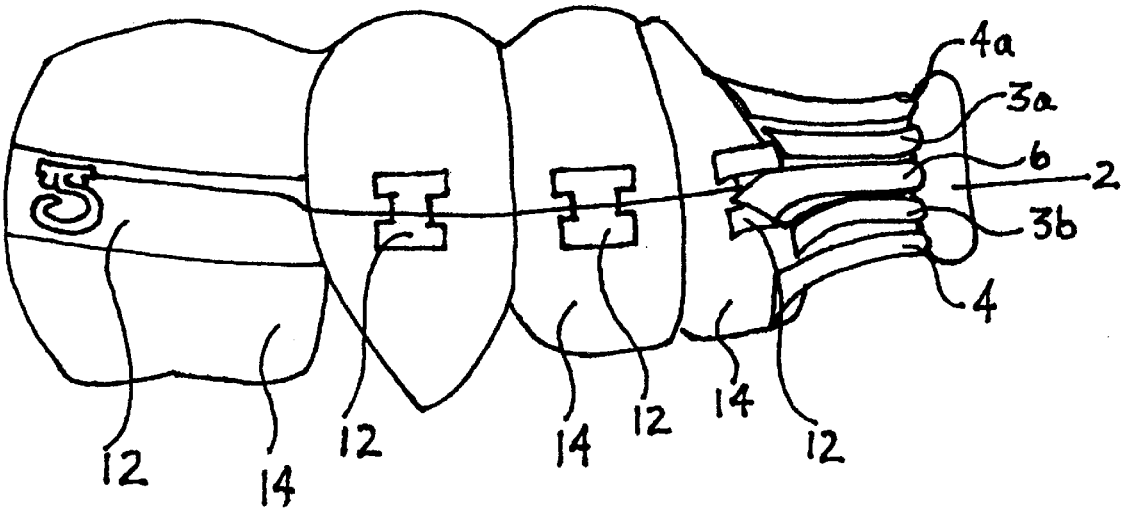
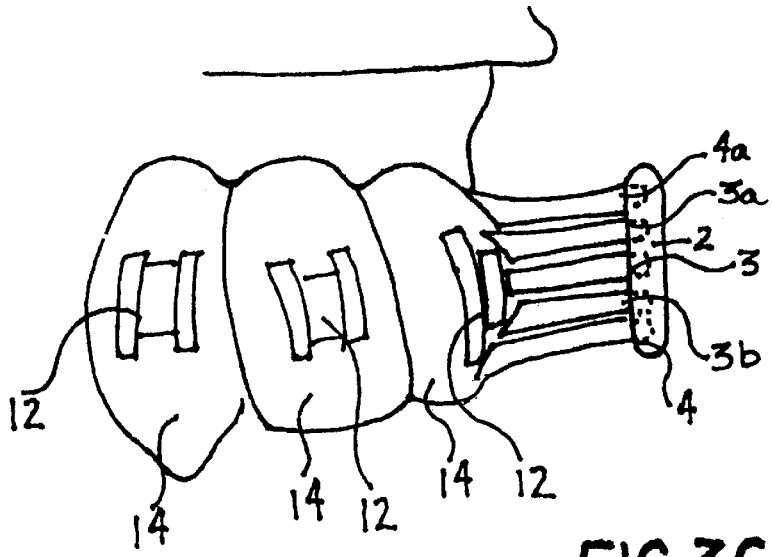
FIG.3C

FIG. 4A
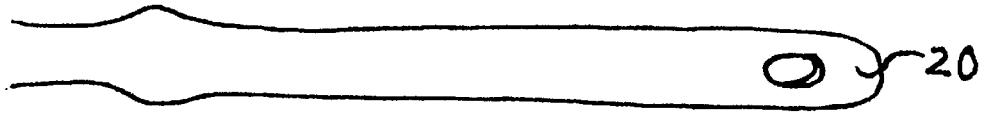
FIG. 4B
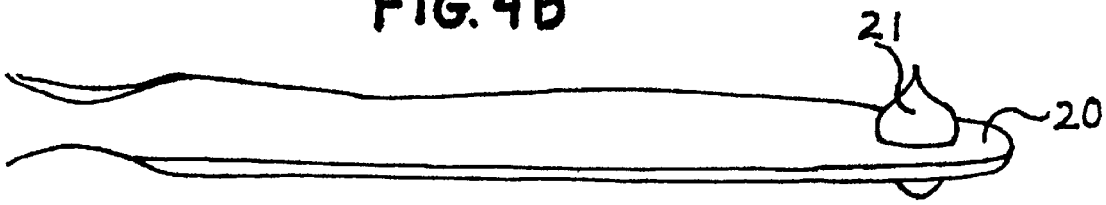
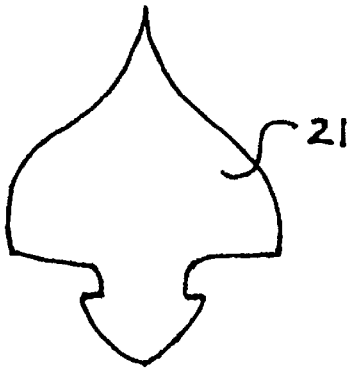
FIG. 4C

FIG. 6A
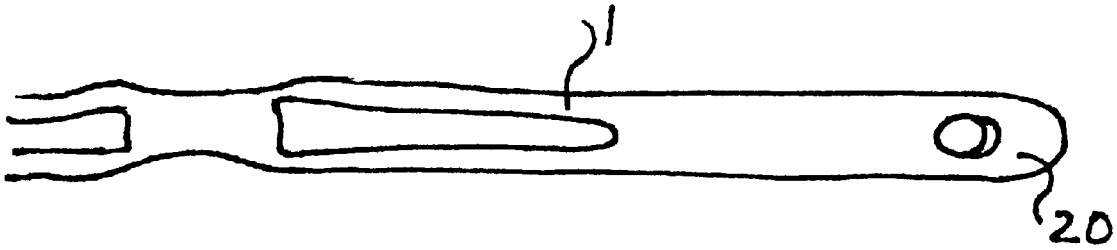
FIG. 6B
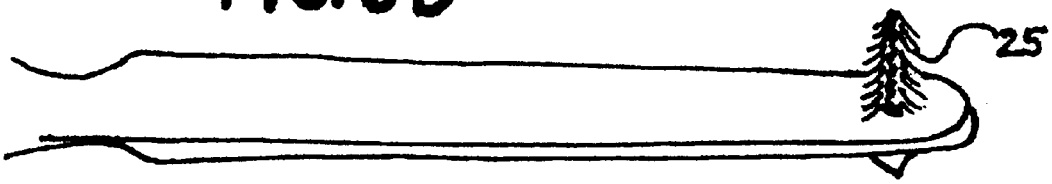
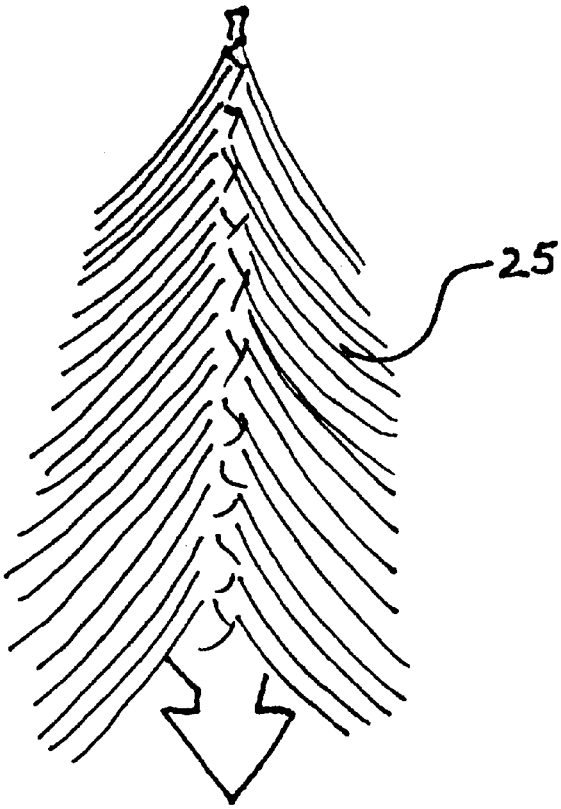
FIG. 6C

ORTHODONTIC TOOTHBRUSH

RELATED APPLICATIONS

This application is a continuation-in-part of application Ser. No. 09/224,468, filed Dec. 31, 1998, now abandoned.

FIELD OF THE INVENTION

The present invention relates to toothbrushes for cleaning hard to reach tooth surfaces in compliance with orthodontic treatment. It is designed to brush and clean braces and the underlying teeth, simultaneously.

BACKGROUND OF THE INVENTION

Toothbrushes for children, adolescents and adults with braces are generally scarce. A special toothbrush must be used for cleaning braces and teeth, since unlike unadorned teeth with flush generally flat faces with rounded edges, braces have a bracket or band which protrudes from the flat surface of a tooth. Square or rectangular shaped braces attached to the front or back surfaces of a tooth are called brackets. Round shaped braces fitting around a tooth, usually in the posterior section of the oral cavity, are called bands. An orthodontic archwire is placed into the brackets and bands and held in by ligature ties or connectors. Since an archwire spans from tooth to tooth, food and debris accumulate interproximally, below the orthodontic bands, brackets and archwires, where food debris and bacteria tend to harbor. These are areas which are difficult to reach with a conventional toothbrush.

Relevant prior art includes U.S. Pat. No. 4,033,008 of Warren, which shows a bristle head with a taller distal set of bristles. U.S. Pat. No. 4,382,309 of Collis, U.S. Pat No. 4,706,322 of Nicholas, U.S. Pat. No. 5,325,560 of Pavone and U.S. Pat. No. 3,678,528 of Haije all show toothbrushes where outer bristles are higher than inside bristles. U.S. Pat. No. 5,628,082 of Moscovich shows a toothbrush with stepped rows of higher and lower bristles. But, these are discrete clumps, not tapered pairs as in the present invention.

Another relevant patent is U.S. Pat. No. 1,018,927 by Sarrazin which has the tallest bristles being rounded bunched bristle tufts. These bristles do not merge to a point. However, having bristles merge to a point is necessary to clean several areas for patients in orthodontic treatment, in order to clean bacterial debris in the distal regions of the most posterior teeth in the mouth, along with point contact above (incisal or occlusal) and below (gingival) to the archwire of braces of a patient in orthodontic treatment. It is impossible to clean the bacterial debris in these areas with the rounded bunched bristle tufts portrayed in FIG. 4 of Sarrazin '927 patent since the rounded tufts of bristles cannot fit between the close proximity of the orthodontics brackets on the teeth.

Also in Sarrazin '927, the outer bunched bristles in FIG. 2 therein are one unitary set of bristles coming to a peaked point. Furthermore, lines 64–66 therein state that the tufts should be spaced to get between the teeth.

Therefore, Sarrazin '927 does not have pairs of outer tufts created by the convergence of two separable and distinct tufts, as proposed in the present orthodontic toothbrush of the invention, which creates a tapered point by an oblique angulation of each tip of each pair of tufts in opposite directions. In contrast to Sarrazin '927, the bristles of the orthodontic toothbrush of the present invention sweep to remove debris on a mesial or distal surface of a tooth, and they can penetrate a greater distance interproximally between the teeth.

Furthermore, groove "c", as shown in FIG. 1 of Sarrazin '927 and described in lines 86–91 therein, was fabricated to help placement of the brush by the patient on the tables (occlusal portion) of certain posterior teeth. In contrast, the shorter bristles in the center of the orthodontic toothbrush present invention are so that a patient's braces and teeth can be reached and cleaned simultaneously, on the facial surface (the surface one can see when a patient is smiling) or lingual surface (the tongue side). Unlike the brush of Sarrazin '927, the orthodontic toothbrush of the present invention help cleans either the facial or lingual surface, dependent upon where the braces are placed-on the inside or outside surfaces of the teeth.

In addition, lines 48–59 and 101–104 of Sarrazin '927 state that Sarrazin's toothbrush requires less bristle rows in the front of the brush than in the rear of it, in a transversely extending direction throughout the toothbrush. In contrast, in the orthodontic toothbrush, of the present invention, there are the same number of rows transversally throughout the toothbrush. This is necessary since braces are placed in the front (anterior) and rear (posterior) sections of the mouth, in the majority of orthodontic cases.

Moreover, U.S. Pat. No. 5,472,972 of Bredall is similar to toothbrush of the aforementioned Warren '008 patent in which all the bristles are flat and do not come to a point, as do the separable pairs of tufts of bristles of the present invention.

Neither Sarrazin '927 nor Bredall '972, either singularly or in combination describe or suggest an orthodontic toothbrush with one large peaked tuft of bristles, and with a gently curving inner surface sloping up from shortest bristles, to medial sized bristles, to taller bristles, wherein the bristles are arranged in adjacent pairs of tufts, wherein further each tuft has oblique distal surfaces that form a split peak when adjacent to each other.

Moreover, the crevice gaps between each tuft of the pairs of tufts of the orthodontic toothbrush of the present invention enable the peaked pairs of tufts to split apart from each other and diverge at the peak, a feature impossible to be accomplished with unitary tufts of Sarrazin '927 or Bredall '972.

Furthermore, the prior art patents do not assert that they are or can be utilized for teeth undergoing orthodontic construction.

To clean orthodontic braces and the teeth to which they are attached, requires a special configuration of pairs of tufts at varying heights, wherein two adjacent pairs of tufts together form a peak separable by a gap between each tuft of each pair of tufts, to maximize both reach and divergence of the cleaning surfaces of the tooth brush upon the respective braces and underlying teeth.

Non-patented prior art includes a ORAL B orthodontic toothbrush of Oral B Laboratories of Belmont, Calif. which is similar to the Collis'309, Nicholas'322, Pavone'560 and Haije'528 patents. The COLGATE TOTAL toothbrush of Colgate-Palmolive Co. of Canton, Mass. is like the brush of Moskovich'082 patents which has stepped rows of higher and lower bristles. But these also are discrete clumps, not tapered pairs with a rippled zigzag configuration as in the present invention.

Tapered pairs with a rippled zigzag configuration are shown in the CREST COMPLETE toothbrush of Proctor and Gamble Co. of Cincinnati, Ohio.

However, none of the prior art toothbrushes provide a toothbrush, which acts to effectively clean the teeth and orthodontic braces of a child, adolescent or adult under orthodontic treatment.

OBJECTS OF THE INVENTION

It therefore is an object of the present invention to provide a toothbrush for children, adolescents and adults with braces.

It is also an object to provide a toothbrush, which can help dislodge oral debris and bacteria by bracing the brackets, bands, archwires and ligature connectors, while simultaneously reaching the teeth, without impinging upon and harming any of the gingival surfaces.

It is also an object to provide a toothbrush, which can clean coronal (top) or apical (bottom) surfaces of a tooth's crown, with an orthodontic bracket or band attachment, in the anterior and posterior regions of the mouth.

It is also an object to provide a toothbrush, which can clean around the coronal (top), apical (bottom) and distal (backside) portions of an orthodontic band, with or without attachments, in the posterior region of the mouth.

It is also an object to provide a toothbrush, which can clean interproximally, between the teeth, and underneath the archwire, in the anterior and posterior regions of the mouth.

It is also an object to provide a toothbrush, which can assist in getting angular brush access to the mesial (toward the facial midline) and distal (away from the facial midline) surfaces of a bracket or band in the anterior and posterior regions of the mouth.

It is further an object to improve over the disadvantages of the prior art.

SUMMARY OF THE INVENTION

The terminology for the following section on bristles is as follows: "shortest" is defined as those bristles bundles in a middle row of the bristle head; "intermediate" is defined as those bristles bundles in single rows adjacent to each side of the shortest row; "taller" is defined as those bristles as the two single most outer, lateral, rows; and, "tallest" is defined as the most distal and tallest bristles on the toothbrush head.

In keeping with these objects and others, which may become apparent, the present invention is a toothbrush for children, adolescents and adults with braces. A special toothbrush must be used for cleaning braces and teeth, since unlike unadorned teeth with flush, generally flat faces, with rounded edges, braces have brackets and/or bands which protrude from the surface of a tooth, wherein the brackets are connected by a spanning archwire.

Therefore, the bristle head of the present invention includes a plurality of rows of bristles designed to contact and brush both the protruding brackets and underlying teeth at the same time.

Briefly, the brush includes a handle with optional interchangeable pointed rubber, bristle and gingivally stimulative extensions in different shapes or forms, to clean between the teeth at one proximal end of the toothbrush, with a bristle head at the other, distal end.

The shortest and intermediate bristles—in height—can dislodge food and debris from the bracket while the intermediate, taller and tallest bristle heights can dislodge food and debris simultaneously from the different crevices and areas of the teeth.

When viewed in a cross section from the handle's end, the shortest group of bristles is in the middle of all the bristle rows. The height of these shortest bristles represents an average protrusive depth of the thickness of a typical bracket or band protruding from a tooth's surface. The shortest bristles help clean the debris from the irregularities within the brackets and bands, where bacteria tend to harbor.

The following are average bracket depths, defined as labiolingual thickness, courtesy of Rocky Mountain Orthodontics and GAC International: RMO SYNERGY Bracket 1.6–2.2 mm, RMO MINI TAURUS Bracket 1.6–2.3 mm, GAC OVATION Bracket 1.3–1.9 mm, GAC MICROARCH bracket 1.3–1.85 mm, GAC OMNIARCH Bracket 1.45–1.7 mm, GAC ALLURE bracket 1.6–2.1 mm, GAC ELAN bracket 1.8–1.9 mm and GAC band depths are an average of 3.65 mm with triple tube attachments.

Laterally are two intermediate groups of bristles which slope outwardly upward, producing a concavity, to encompass a bracket or band. The intermediate height bristles are utilized to assist in removing and cleaning food debris and bacteria harboring on the incisal/occlusal (top) and gingival (bottom) portions of a tooth's crown and orthodontic bracket or band.

At the most lateral or outer edges is a pair of taller bristles, also with sloped surfaces extending outwardly upward, enabling the bristles to remove the bacteria harboring on the incisal or occlusal (top) and gingival (bottom) portion of a tooth's crown or orthodontic attachment.

When viewed laterally, from the side, the bristles include pairs of bristles each having slanted surfaces extending toward a middle high point. This creates V-shaped recesses between adjacent pairs of bristles. Furthermore, the tallest bristles at the distal end of the toothbrush's head can be viewed. The tallest bristles are utilized to clean interproximally, between the teeth and at the mesial and distal portions of a tooth's surface of a bracket or band, in the anterior or posterior regions of the mouth.

The tallest bristles blend in a concavity toward the tallest distal set of bristles to assist in getting brush access to an orthodontic band's attachments in the posterior region of the mouth.

By the above configuration the user can brush around all sides of each bracket and band, as well as underneath the spanning archwire and all surfaces of a tooth.

The preferred embodiment of the present invention includes an orthodontic toothbrush for cleaning braces, including brackets and bands, which are adhered to teeth, while the brush is simultaneously used for cleaning the teeth. For example, the orthodontic toothbrush of the present invention is used where each tooth has a bracket or band which protrudes from the surface of a tooth, and wherein each bracket and band is connected by a spanning archwire.

The toothbrush has a longitudinally extending handle attached to a tooth cleaning head having a plurality of bristles extending upward from a bottom within the bristle head to a top thereof.

In contrast to the prior art and in furthermore of the objects of the present invention, the orthodontic toothbrush of the present invention has a plurality of adjacent pairs of tufts of bristles extending upwardly from the bristle head in a plurality of longitudinally disposed rows. These tufts have bristles projecting upward parallel to one another wherein the tufts of bristles respectively contact adjacent tufts, along the entire length of the tufts from bottom to top.

The plurality of pairs of adjacent tufts form a mass of parallel bristles, each tuft being a solid, unbroken unspaced mass extending from the bristle head upward to the tops of the respective bristles of the tufts.

Each tuft has bristles having top-to-bottom lengths, which varying to form a contoured tooth contact surface, formed by the tops of the plurality of respective bristles.

Except for the smallest tufts in the middle of the bristles, and the singular large tuft at the distal end, preferably these tufts are discrete separable aggregate pairs of bristles, separated by gaps, splitting upon pressure from contact with teeth between respective adjacent pairs of tufts, wherein the tuft gaps split and run vertically along the top-to-bottom length of the adjacent pairs of tufts. These split-apart tuft pairs have bristles urged into varying directions according to each tuft by pressure of their contact with teeth, so that the bristles of differing tufts are being separately and differentially inserted into the gaps between teeth and into the spaces between the orthodontic brackets and tooth surfaces.

The contoured tooth contact surface also forms a depressed center of inner rows of tufts disposed on the bristle head, wherein the inner bristles are the relatively shortest bristles.

The contoured tooth contact surface also has upwardly and outwardly sloped medial rows of tufts disposed on the bristle head, which are relatively longer than the shortest inner bristles. These medial rows of tufts are disposed laterally outward on both sides of the inner rows of tufts.

Furthermore, the contoured tooth contact surface has an elevated perimeter of outer rows of tufts disposed on the bristle head, which outer bristles are relatively taller bristles.

The inner rows of tufts have a plurality of tooth contact surface facets, corresponding to individual tufts and the facets form an inner portion of the contoured tooth contact surface.

These inner rows form a tooth contact surface sloping gently upward from a center toward the outer rows of tufts.

The outer perimeter pairs of tufts form a tooth contact surface with a plurality of peaks, of separable pairs of adjacent perimeter tufts having top tooth contact surfaces sloping downwardly away from the point of mutual tuft pair contact.

These peaked pairs of tufts are separable in a gap splitting and running vertically along the top-to-bottom length of the adjacent pairs of tufts, wherein each respective peak when contacted by teeth, includes tuft pairs which are separately and differentially insertable into gaps between teeth and into spaces between orthodontic brackets and tooth surfaces.

At a distal end, the bristle head has at least one distal tuft which is preferably from about 10% to about 20% taller than the perimeter, medial and inner tufts in contact with the distal tuft, to assist in getting brush access to the band attachments and brace fasteners in the posterior region of the mouth.

This distal tuft has a tooth contact surface with oblique angulation extending in opposite directions, in an upwardly facing point.

The toothbrush cleans interproximally beneath the spanning archwire, and the mesial and distal tooth and bracket or band surfaces, in the anterior and posterior regions of the mouth.

The height of the shortest-bristle inner tuft rows represents the average protrusive depth of the thickness of each bracket protruding from each tooth surface.

At the distal end of the bristle head the tallest bristles are used to clean from around each coronal crown end of each tooth to each apical gum end of each tooth at the rear posterior portions of the mouth.

Other options include having a gripping surface like the handle part of the CREST COMPLETE toothbrush, as well as interchangeable heads, so that one can take off the brace modified bristle head for a conventional head for the lingual tongue side of teeth without brackets, as well as some kind of joint to set the orientation of the toothbrush head at 45 degrees in conjunction with the American Dental Association's recommendation of brushing utilizing the Modified Bass Technique.

BRIEF DESCRIPTION OF THE DRAWINGS

The present invention can best be understood in connection with the accompanying drawings in which:

FIG. 3B is a front elevational view of the toothbrush as in FIG. 3A in use;

FIG. 3C is a rear cross-sectional view thereof;

FIG. 4A is a top plan view of the handle as in FIG. 4, without a stimulator attached;

FIG. 4B is a perspective view thereof, with the stimulator attached;

FIG. 4C is a front elevational view of the stimulator as in FIG. 4B; thereto;

FIG. 6A is a top plan view of the handle as in FIG. 4, without a stimulator attached;

FIG. 6B is a perspective view thereof with the stimulator attached;

FIG. 6C is a perspective view thereof with the stimulator attached;

DETAILED DESCRIPTION OF THE INVENTION

Figure 1:
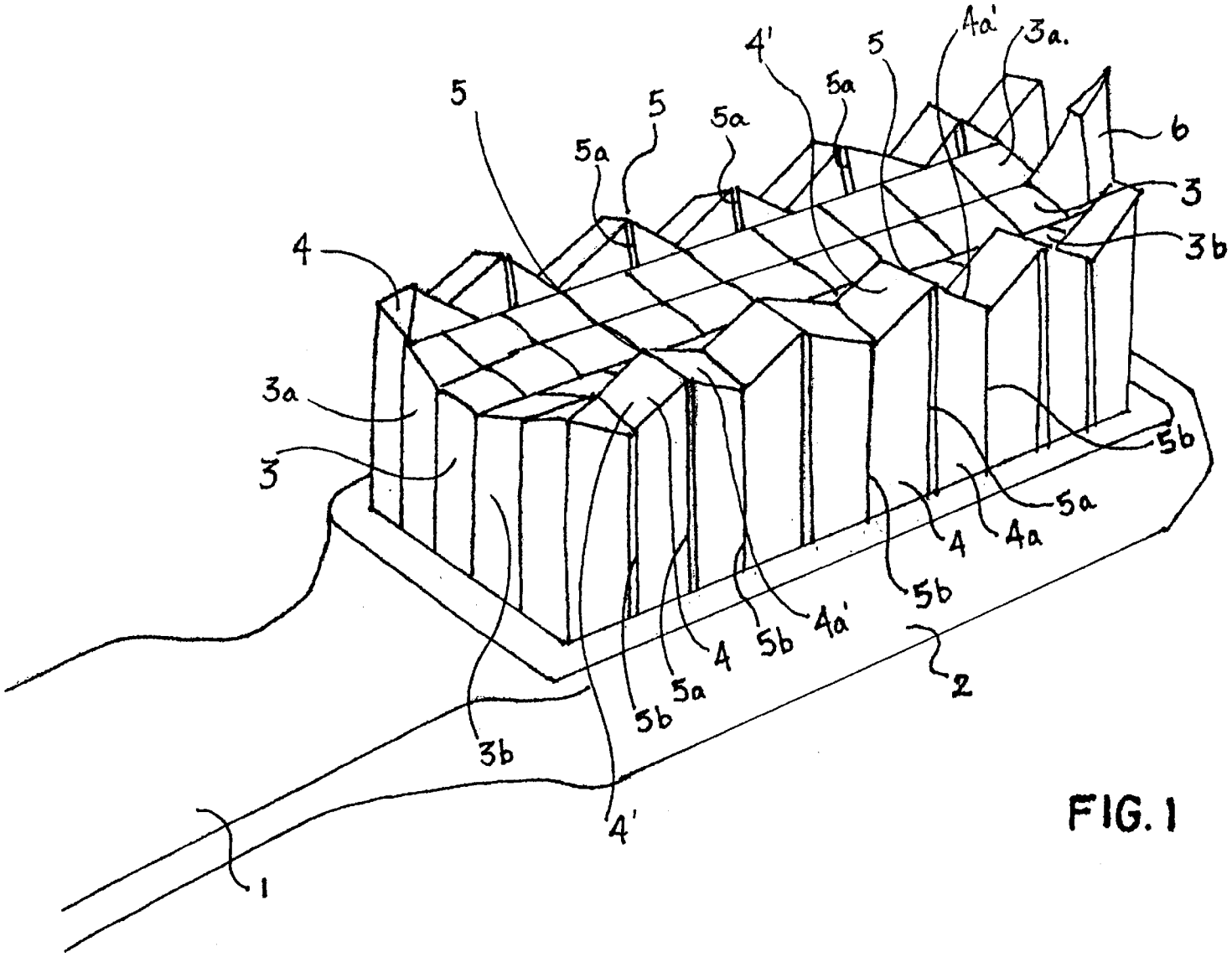
FIG. 1 is a left side perspective detail of an orthodontic toothbrush of this present invention.
Figure 1A:
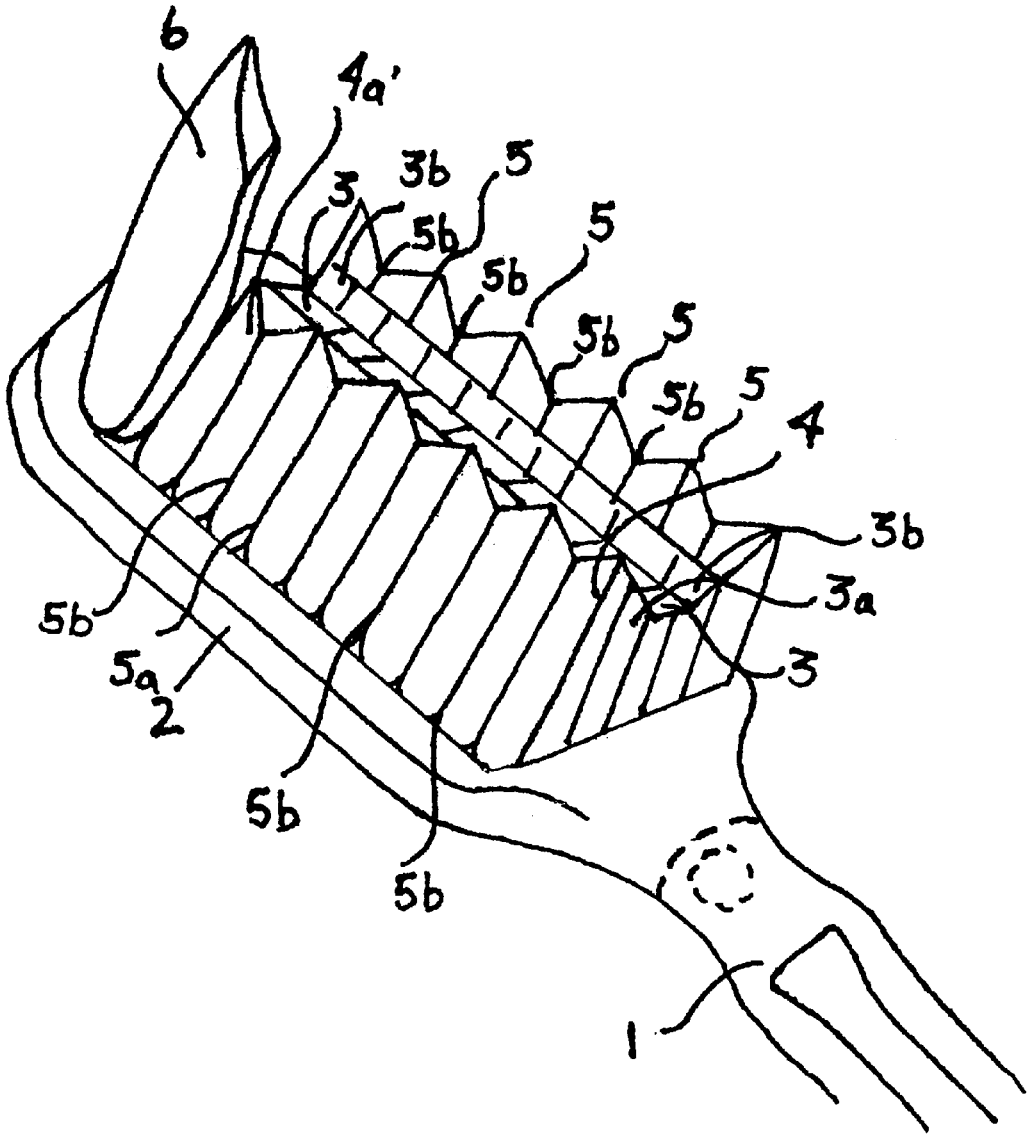
FIG. 1A is a right side perspective view thereof.
Figure 1C:
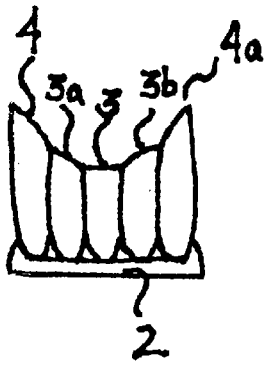
FIG. 1C is a rear view detail of the bristle portion thereof.
Figure 1B:
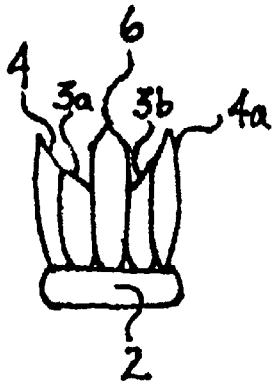
FIG. 1B is a front view thereof.
Figure 1D:
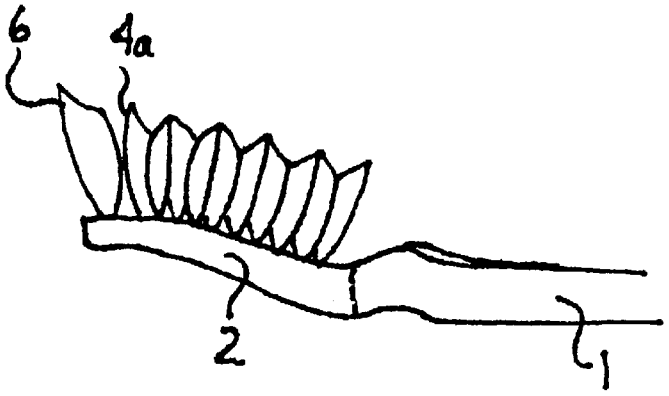
FIG. 1D is a right side elevational detail view thereof.

FIGS. 1, 1A, 1B, 1C and 1D show an enlarged view of the bristle head 2 of this invention. This is attached to toothbrush handle 1 having friction inducing gripping surface 1*a* thereon and shows several features. The medial bristle bundles 3 are the shortest. The bristle bundles 3*a*, 3*b* on either side slope outward to form a concavity. At the outer edges, pairs of taller bristle bundles 4, 4*a* also have sloped surfaces extending outwardly. One or more tallest bristle bundles 6 at the distal end are used to clean around the inner teeth at the ends of the rows. When viewed laterally, pairs of bristle bundles 4, 4*a* extend to a point such as denoted by 5 to create wedges to gain access interproximally between two adjacent teeth.

Figure 2:
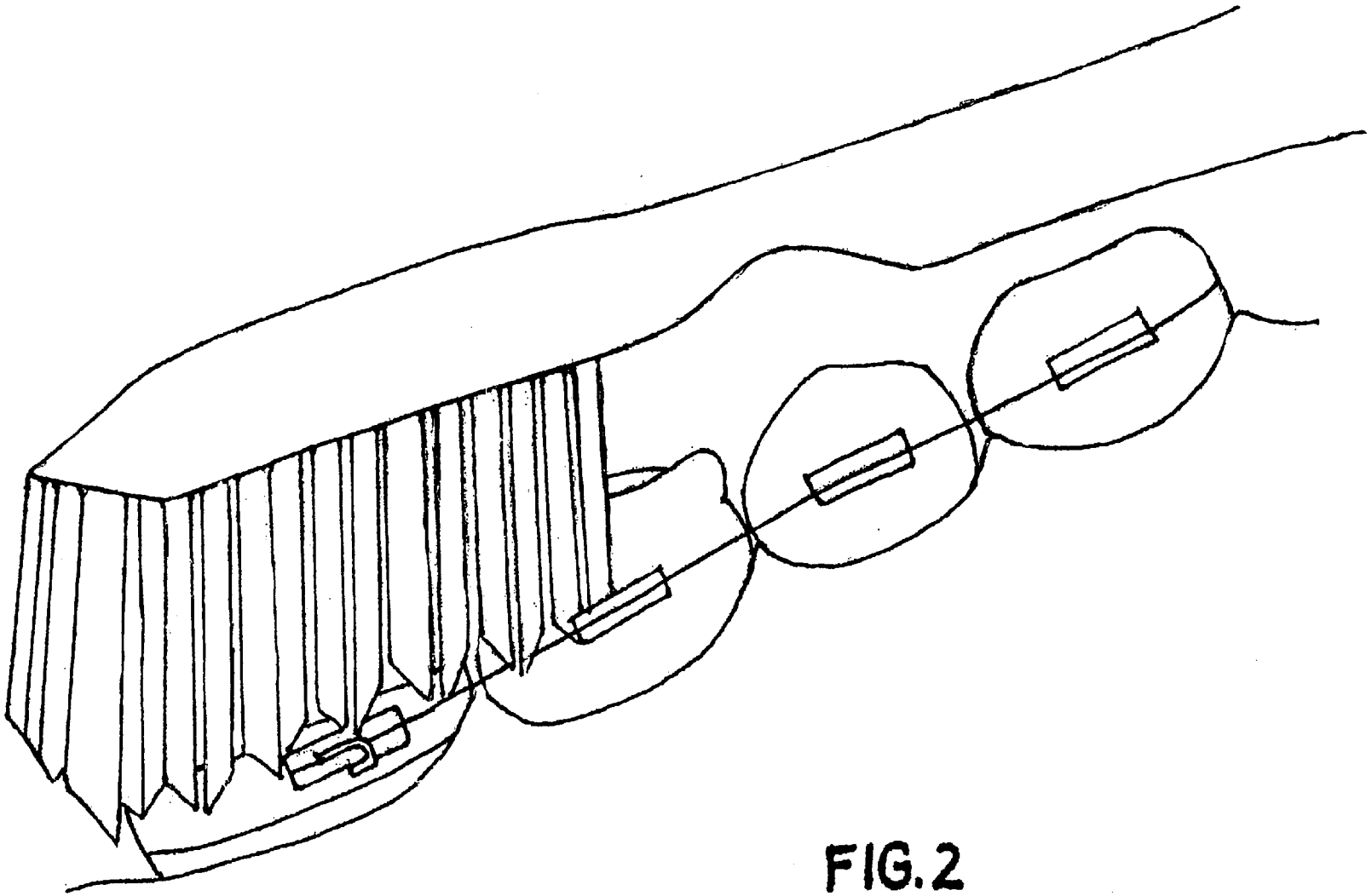
FIG. 2 is a perspective side view of the toothbrush in use.

FIG. 2 shows the cleaning method by tallest peaked bristle bundle 6 at the end of a row of teeth 14. The wire 13 is anchored at joint 11 to orthodontic band 10 and rides on brackets 12. This view of FIG. 2 shows the use of the brush as applied to dentition on the posterior region.

Figure 3:
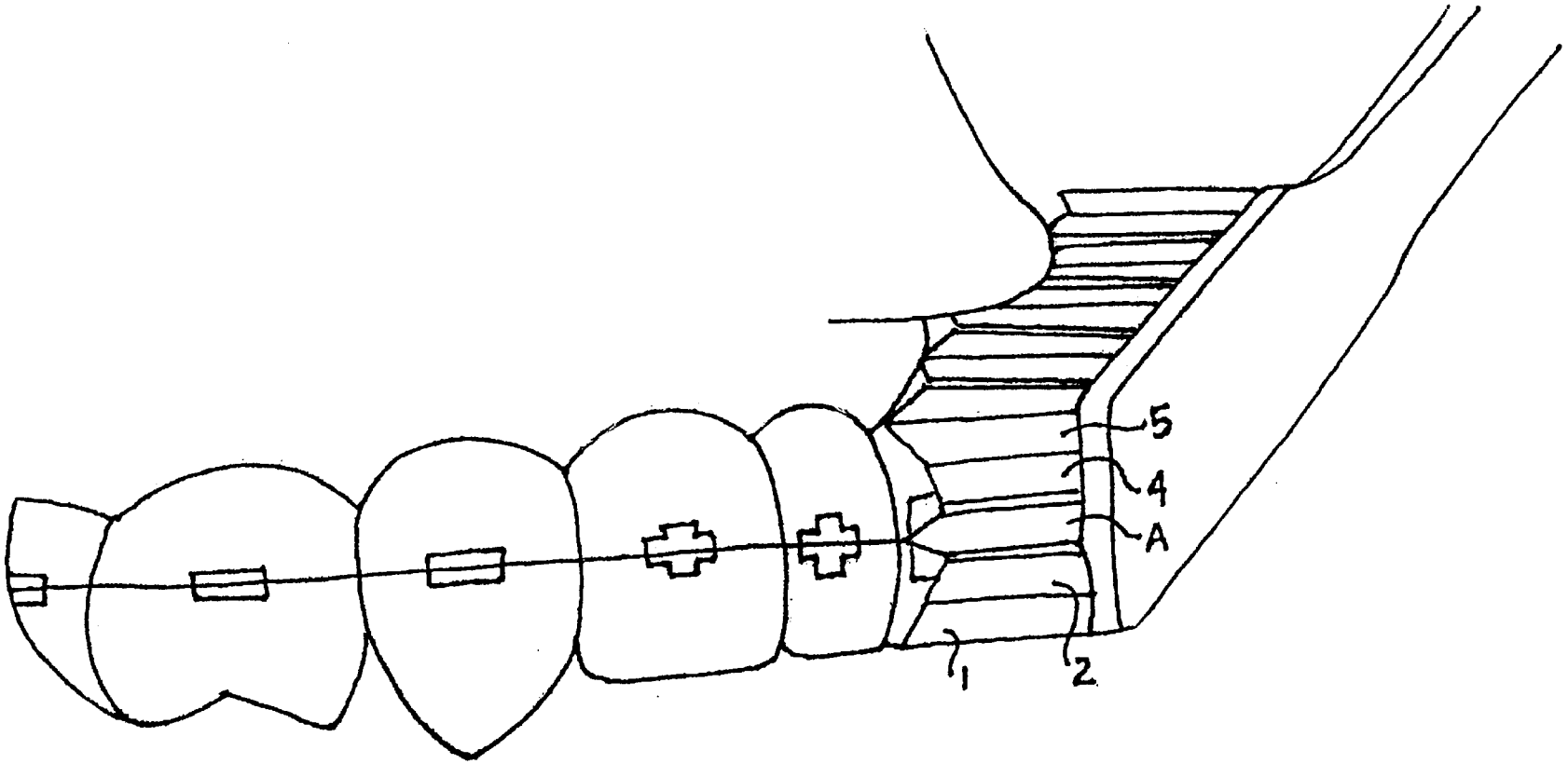
FIG. 3 is a perspective distal end view of the toothbrush in use.
Figure 3A:
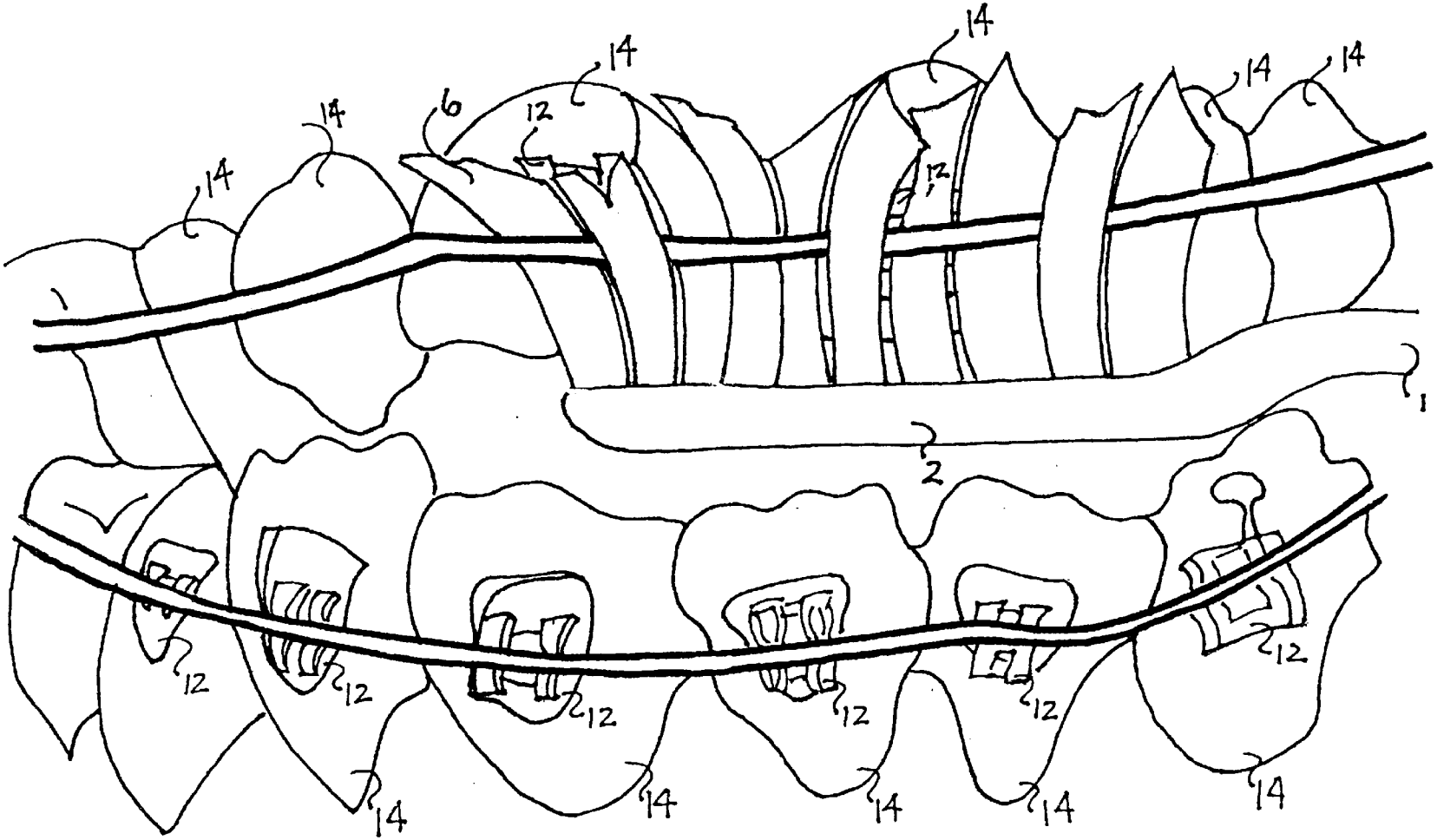
FIG. 3A is a perspective view of the toothbrush in use, showing the divergence of adjacent tufts of pairs of tufts upon contact with teeth and orthodontic surfaces.
Figure 4:
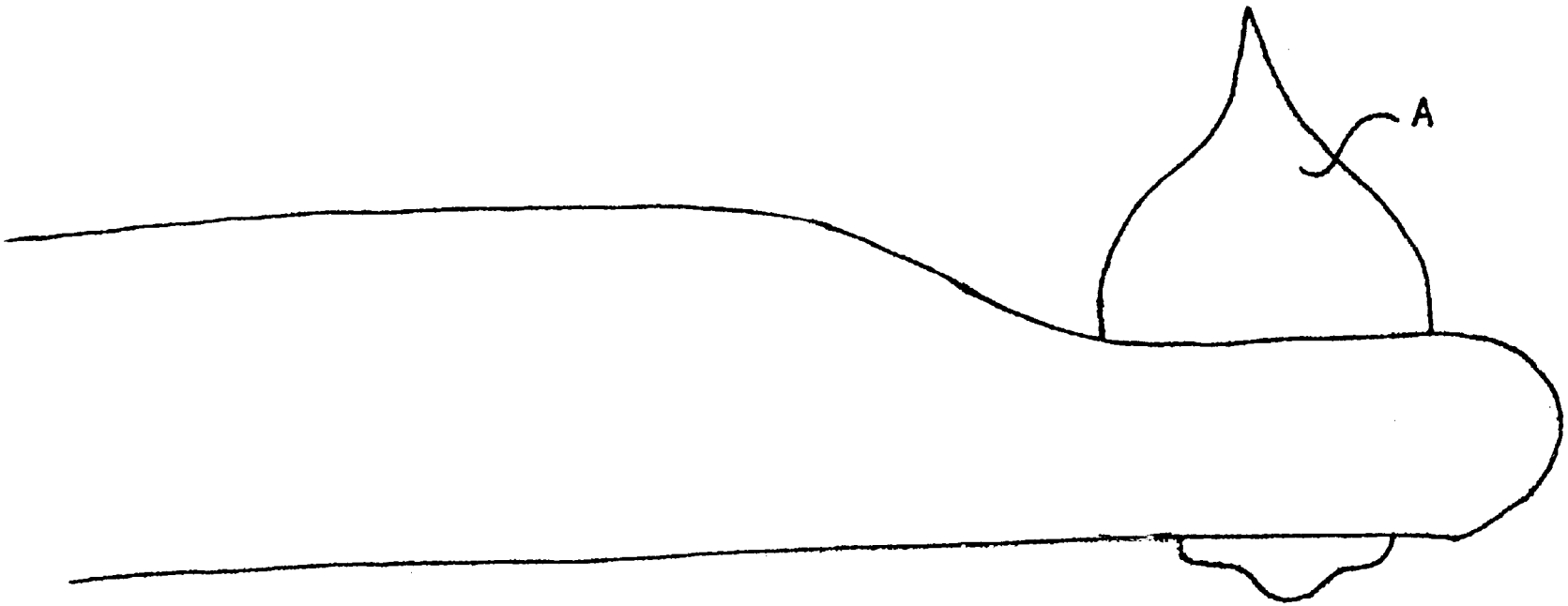
FIG. 4 is a side view detail of the handle end thereof with a flexible gingival stimulator thereon.

FIG. 3 is a right anterior view showing the end of bristle head 2 applied to dentition, showing the preferred fit of the bristle end contour.

FIGS. 1, 2, 3, 3A, 3B and 3C also show that toothbrush 1 includes a plurality of adjacent pairs of tufts 4, 4*a* of bristles extending upwardly from bristle head 2 in a plurality of longitudinally disposed rows, wherein pairs of tufts 4, 4*a* have groups of bristles projecting upward parallel to one another.

The pairs of tufts 4, 4*a* of bristles respectively contact respective adjacent tufts 4, 4*a* along the entire length of tufts 4, 4*a* from proximal bottom end at bristle head 2 to respective distal top surfaces 4', 4*a'*.

The plurality of adjacent tufts 4, 4*a* each have a mass of parallel bristles, with each bristle mass including a solid, unbroken un-spaced mass extending upward from bristle head 2 to the respective top surfaces 4', 4*a'* of each respective tuft pair 4, 4*a* of bristles. The pairs of tufts 4, 4*a* have bristles having top-to-bottom lengths, with the lengths varying to comprise respective contoured tooth contact surfaces 4', 4*a'*. Each tooth contact surface 4', 4*a'*is at the peaked distal tops 5 of the plurality of respective pairs of tufts 4, 4*a* of bristles.

Each of the tufts 4, 4*a* are discrete separable aggregates of bristles separated by linearly extending gaps 5*a*, contact surfaces 5*b*, wherein the respective pairs of tufts 4, 4*a* are separable into split pairs of tufts 4, 4*a* upon pressure from contact with teeth 14 between respective adjacent pairs of tufts 4, 4*a*. The tuft gaps 5*a*, run vertically along the top-to-bottom length of the adjacent pairs of tufts 4, 4*a*, wherein the pairs of tufts 4, 4*a* are split-apart and urged into varying directions according to each tuft 4, 4*a* by pressure of contact with teeth 14. The bristles of differing pairs of tufts 4, 4*a* are separately and differentially insertable into gaps between surfaces of teeth 14 and into spaces between orthodontic brackets 12 and wires 13.

The medial contoured tooth contact surface is a depressed center of inner rows of shorter tufts 3 located on bristle head 2, wherein the tufts 3 of inner bristles are relatively shortest bristles.

Between shortest tufts 3 and taller pairs of tufts 4, 4*a* are upwardly and outwardly sloped medial rows of tufts 3*a*, 3*b* attached to bristle head 2,wherein these medial bristles of tufts 3*a*, 3*b* have bristles relatively longer than the shortest inner bristles of shortest tufts 3, but the medial rows of pairs of tufts 3*a*, 3*b* are located laterally outward on both sides of the inner rows of shortest tufts 3.

The contoured tooth contact surface has at an elevated perimeter the pairs of outer rows of tufts 4, 4*a* located on the outer sides of bristle head 2, wherein the outer tufts 4, 4*a* of bristles are relatively taller bristles than medial tufts 3*a*, 3*b* or inner tufts 3.

The top surfaces 4', 4*a'* of rows of tufts 4, 4*a* are a plurality of angled tooth contact surface facets.

The inner rows of shortest tufts 3 and medial tufts 3*a*, 3*b* become a tooth contact surface sloping gently upward from a center at shortest tufts 3 toward the outer rows of pairs of tufts 4, 4*a* on the perimeter of toothbrush head 2. These perimeter pair of tufts 4, 4*a* have a pairs of tooth contact top surfaces 4', 4*a'* extending together to form a plurality of peaks 5 separated by gaps 5*a*. The peaks 5 of pairs of tufts 4, 4*a* slope downwardly away from the highest point 5 of mutual tuft pair contact, and the peaked pairs of tufts 4, 4*a* are separable by gaps 5*a* forming respective splits running vertically along the top-to-bottom length of the adjacent pairs of tufts 4, 4*a*. The respective tufts 4, 4*a* are separately and differentially insertable into gaps between teeth 14 and into spaces between orthodontic brackets 12 and wires 13 and adjacent tooth surfaces.

Moreover, bristle head 2 has a distal end having at least one distal peaked tuft 6 therein, wherein distal tuft 6 is preferably from about 10% to about 20% taller than the perimeter pairs of tufts 4, 4*a* in contact with distal tuft 6 to assist in getting brush access to the band attachments and brace fasteners in the posterior region of the mouth.

The peaked distal tuft 6 forms a tooth contact surface having oblique angulation in opposite directions further forming an upwardly facing point.

Therefore toothbrush 1 is for cleaning interproximally beneath the spanning archwire, and the mesial and distal tooth and bracket or band surfaces, in the anterior and posterior regions of the mouth.

The height of the shortest-bristle inner rows of tufts 3 represents the average protrusive depth of the thickness of each bracket 12 protruding from each tooth surface.

At the distal end of the bristle head 2 the tallest tuft 6 of bristles is used to clean from around each coronal crown end of each tooth 14 to each apical gum end of each tooth 14 at the rear posterior portions of the mouth.

FIGS. 4, 4A, 4B and 4C show a flexible gingival stimulator 21, such as of rubber or other suitable material, attached to a handle 1 at extension 20.

Figure 5:
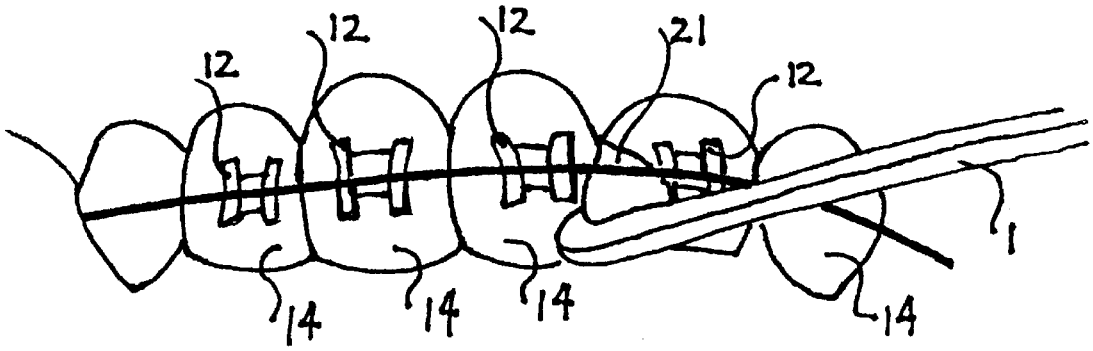
FIG. 5 is a side view of the gingival stimulator in use.
Figure 6:
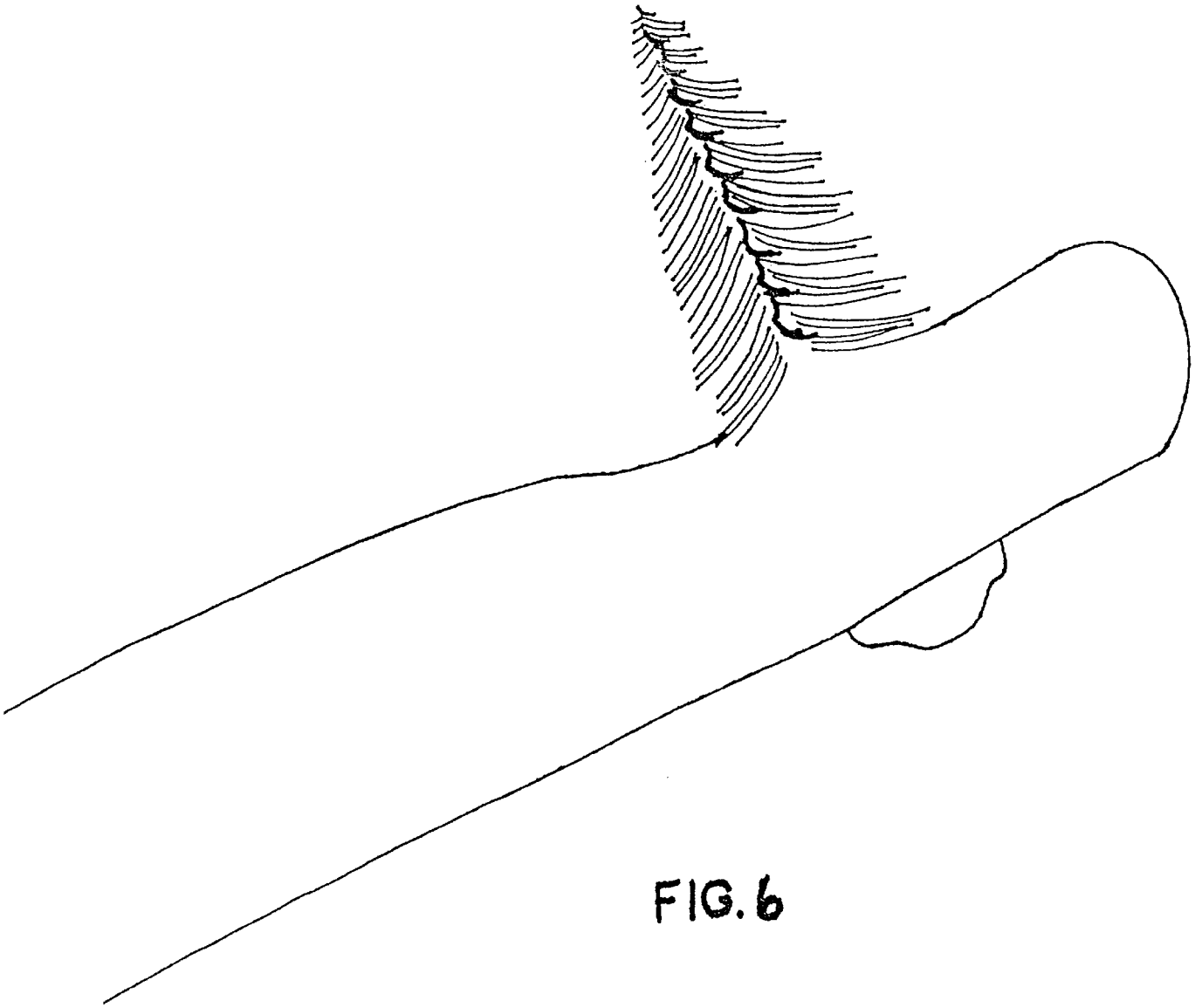
FIG. 6 is a side view detail of the handle end of the toothbrush with conical bristles thereon.

The cleaning technique with the gingival stimulator is illustrated in FIG. 5.

FIGS. 6, 6A, 6B and 6C show a conical brush 25 attached to handle 1 at extension 20.

Figure 7:
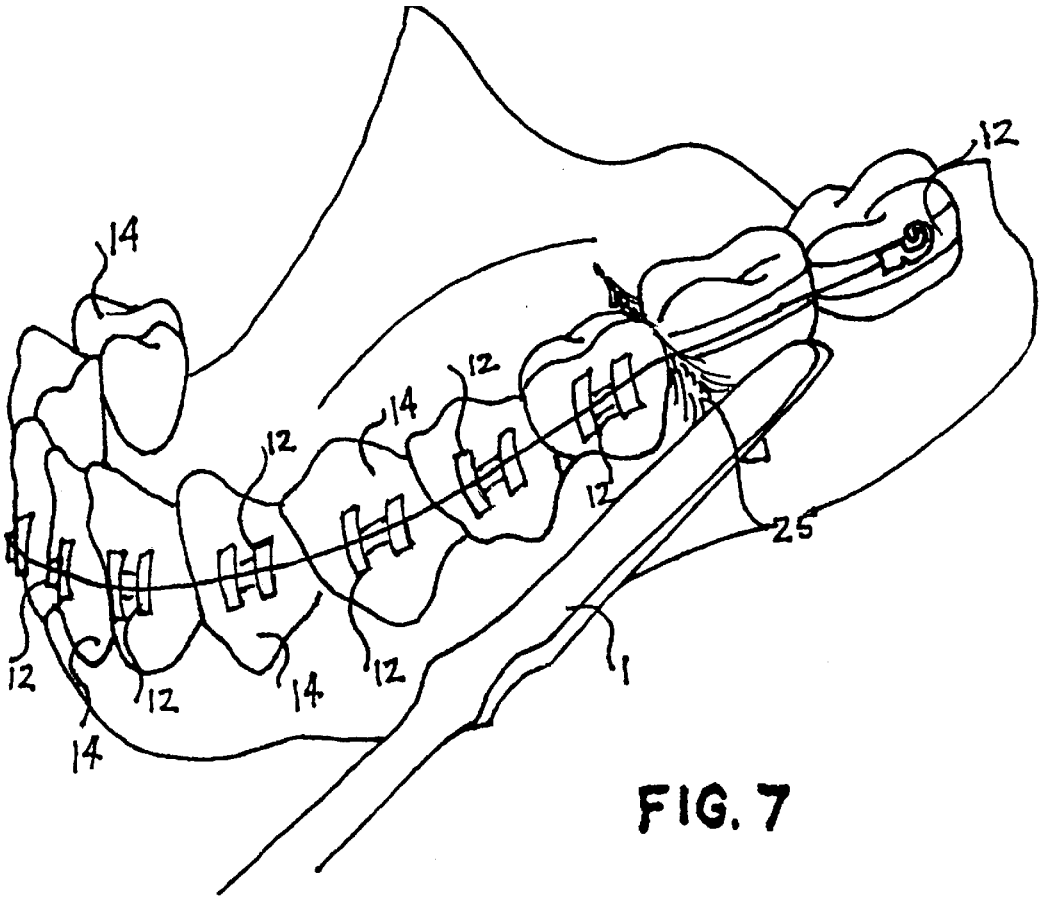
FIG. 7 is a side view of the conical brush in use.

The cleaning technique with the brush 25 fitting between wire 13 and teeth 14 is shown in FIG. 7.

Figure 8:
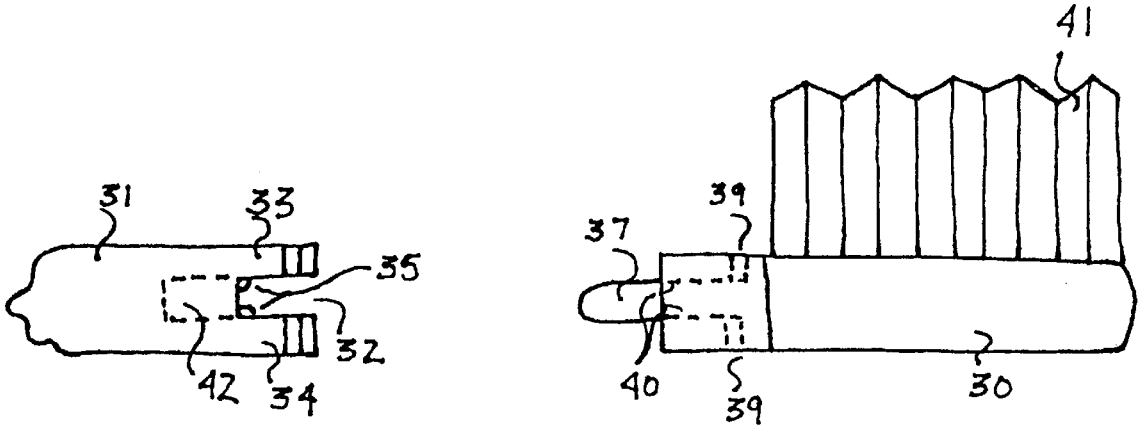
FIG. 8 is a side view detail of a removable adjustable bristle head for the toothbrush.
Figure 9:
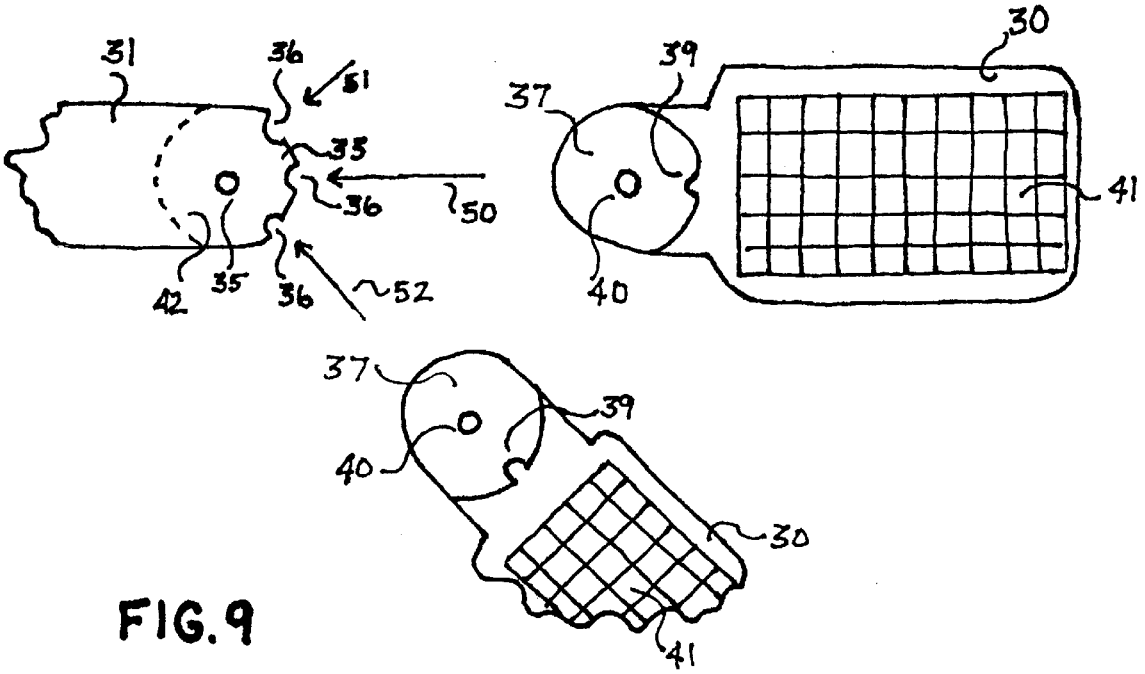
FIG. 9 is a distal end view detail of the removable adjustable bristle head.
Figure 9A:
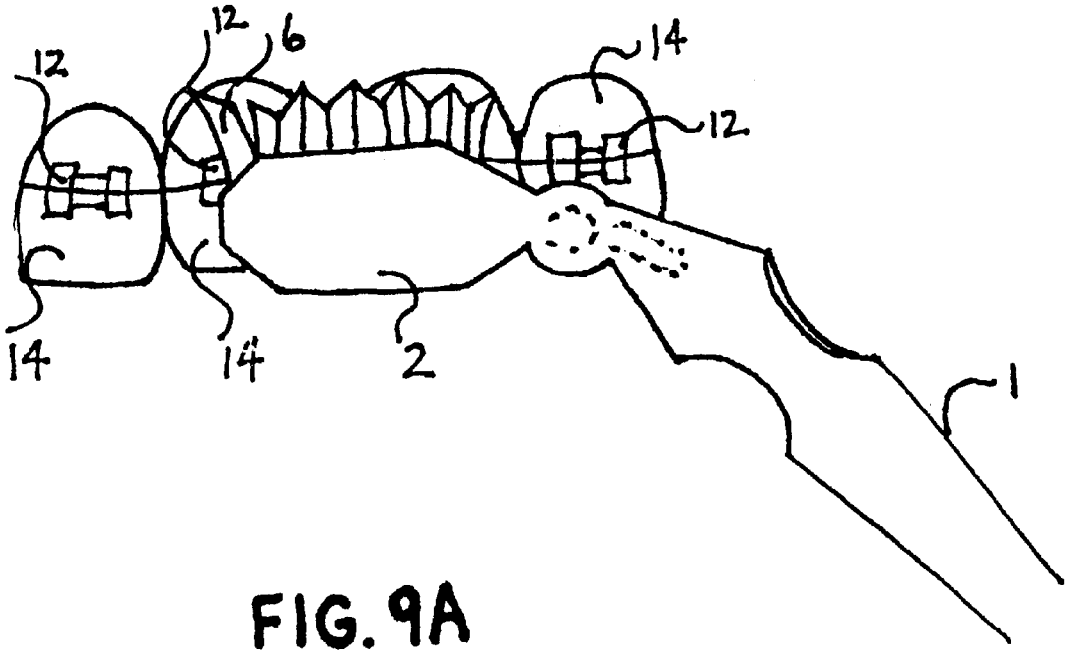
FIG. 9A is perspective view of a toothbrush with the removable head as in FIGS. 8 and 9.
Figure 9B:
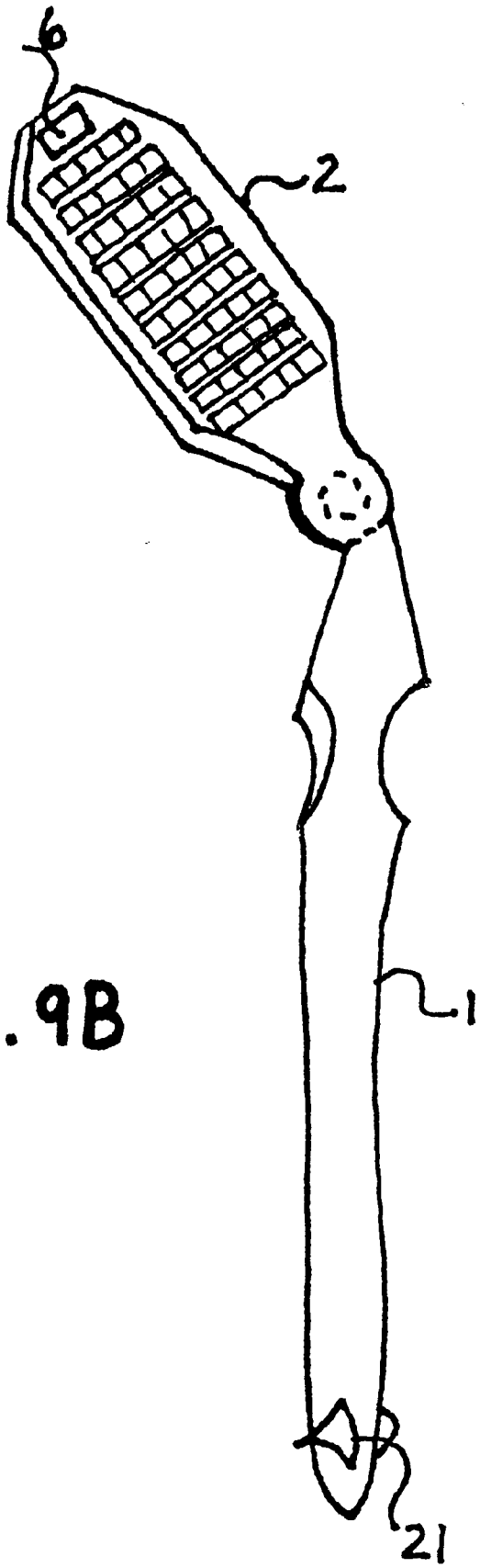
FIG. 9B is a top plan view thereof.
Figure 9C:
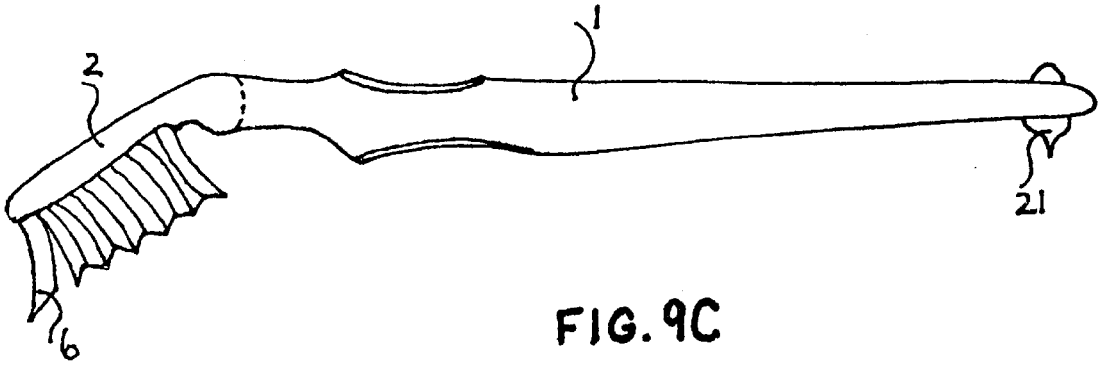
FIG. 9C is a left side view thereof; shown upside down.
Figures 9D, 9E:
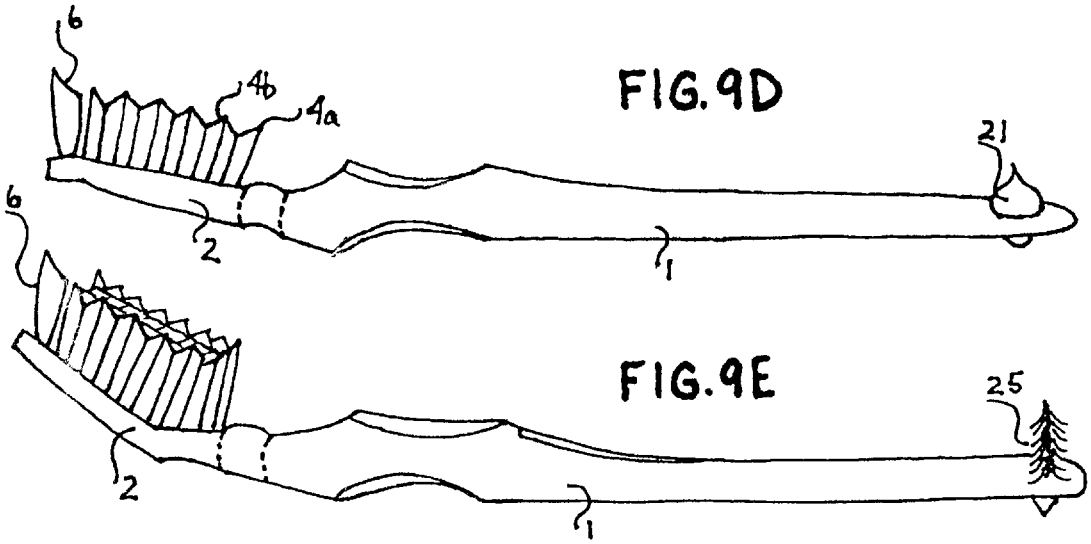
FIG. 9D is a right side elevational view thereof.
FIG. 9E is a perspective view thereof.
Figure 10:
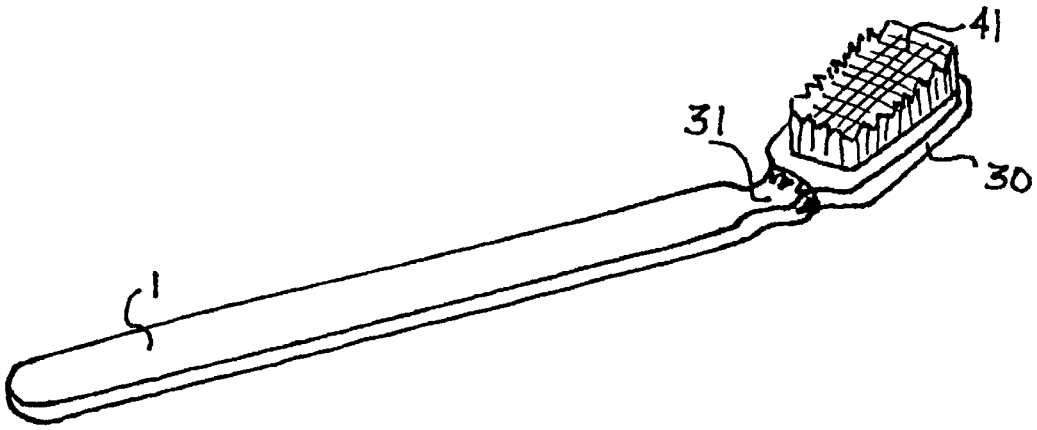
FIG. 10 is a distal end view of the toothbrush with a removable adjustable bristle head, illustrated at three permissible positions, preferably vertical and two angled at 45 degrees; and, FIG. 11 is an alternate embodiment side view detail of a toothbrush with a curved bristle head.

In an alternate embodiment illustrated in FIGS. 8 through 10, the bristle head of the orthodontic toothbrush is removable so that it can be replaced with a more conventional bristle head 30 for cleaning the lingual side of the teeth. In addition, one conventional vertical position is shown along with two other alternate positions at 45 degree angles to handle 1, in addition to the straight (in-line) vertical position. In all positions, the bristle head 30 remains collinear with handle 1.

To accomplish these goals, handle 1 is fitted with a short engagement rod 32 with three dimples 33 (two are shown) spaced at 45 degrees apart along the periphery of rod 32. This fits into segmented collar 31 with latch segment 34 and engagement nib 35 at the end of bristle head 30. Both the orthodontic bristle head 2 and the conventional bristle head 30 may be fitted with these mating features, although only the conventional bristle head 30 is illustrated in FIG. 8.

FIG. 9, which is an end view of bristle head 30, shows the engagement apparatus more clearly.

Figure 11:
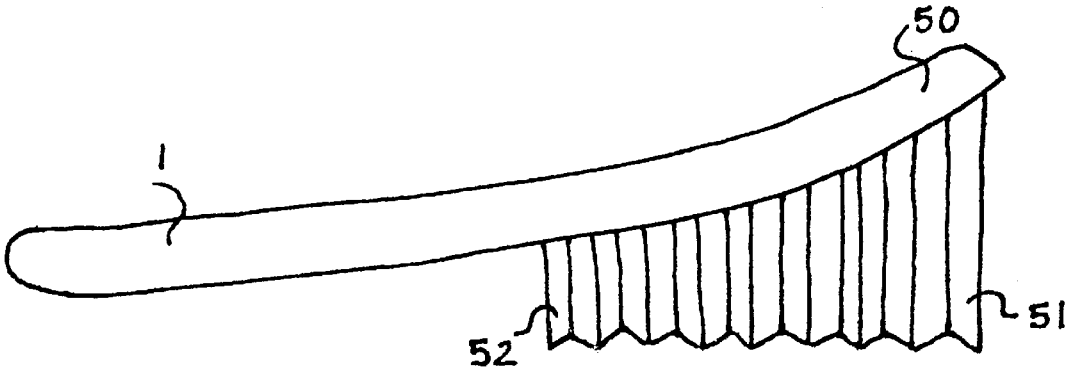

FIG. 10 is a distal end view of a toothbrush with these rotatable features, showing three permissible positions A, B and C. Bristle head 30 is shown rotated 45 degrees clockwise relative to the position of handle 1. Phantom views show the aligned position at B and the counterclockwise position at A. Detailed mold design and selection of appropriate molding resin characteristics determine the forces required for bristle head replacement and rotation FIG. 11 shows a further alternate embodiment using a bristle head 50 with continuously curved bundles of bristles. Bristle bundle lengths vary uniformly from the shortest 52 to those at the distal end 51 which are the longest. The variation of bristle bundle lengths from the proximal to the distal ends follows a smooth curve 53.

It is further noted that other modifications may be made to the present invention without departing from the scope of the invention, as noted in the appended claims.

We claim:

1. An orthodontic toothbrush for cleaning braces, including brackets and bands, adhered to teeth while simultaneously cleaning the teeth, wherein each said tooth has a bracket or band which protrudes from the surface of a tooth, wherein further said bracket and band is connected by a spanning archwire, wherein further the toothbrush has a longitudinally extending handle attached to a tooth cleaning head having a plurality of bristles extending upward from a bottom within said bristle head to a top, said tooth brush comprising:

a plurality of adjacent pairs of tufts of bristles extending upwardly from said bristle head in a plurality of longitudinally disposed rows, said pairs of tufts comprising bristles projecting upward parallel to one another and wherein said pairs of tufts of bristles respectively contact adjacent pairs of tufts along respective contact surfaces extending along the entire length of said pairs of tufts from bottom to top;

said plurality of adjacent pairs of tufts comprising a mass of parallel bristles, said bristle mass comprising a solid, unbroken un-spaced mass extending from said bristle head upward to said tops of said respective bristles;

said pairs of tufts having bristles having top-to-bottom lengths, said lengths varying to comprise a contoured tooth contact surface, said tooth contact surfaced being comprised of the tops of said plurality of respective bristles;

said pairs of tufts comprising discrete separable aggregates of bristles; said separability comprising gaps splitting upon pressure from contact with teeth between respective adjacent pairs of tufts, said tuft gaps splitting and running vertically along the top-to-bottom length of the adjacent pairs of tufts, said split-apart tuft pairs comprising bristles urged into varying directions according to tuft by pressure of contact with teeth, said bristles of differing tufts being separately and differentially insertable into gaps between teeth and into spaces between orthodontic brackets and tooth surfaces;

said contoured tooth contact surface comprising a depressed center comprised of inner rows of tufts disposed on said bristle head, said inner bristles comprising relatively shortest bristles; and said contoured tooth contact surface comprising upwardly and outwardly sloped medial rows of tufts disposed on said bristle head, said medial bristles comprising bristles relatively longer than said shortest inner bristles, said medial rows of tufts being disposed laterally outward on both sides of said inner rows of tufts; and said contoured tooth contact surface comprising an elevated perimeter comprised of outer rows of tufts disposed on said bristle head, said outer bristles comprising relatively taller bristles; and wherein said inner rows of tufts comprise a plurality of tooth contact surface facets, said facets corresponding to individual tufts and said facets comprising an inner portion of said contoured tooth contact surface; and wherein said inner rows comprise a tooth contact surface sloping gently upward from a center toward said outer rows of tufts; and said perimeter tufts comprising a tooth contact surface having a plurality of peaks, said peaks comprising separable pairs of adjacent perimeter tufts having top tooth contact surfaces sloping downwardly away from the point of mutual tuft pair contact, each tuft of each pair of said peaked pairs of tufts being separated from an adjacent tuft of each pair of peaked tufts by a gap splitting and running vertically along the top-to-bottom length of each tuft of said adjacent pairs of tufts comprising each respective peak when contacted by teeth, said peaked tuft pairs being separately and differentially insertable into gaps between teeth and into spaces between orthodontic brackets and tooth surfaces; and wherein said bristle head comprises a distal end having at least one distal tuft therein, said at least one distal tuft being taller than the perimeter, medial and inner tufts in contact with said distal tuft to assist in getting brush access to the band attachments and brace fasteners in the posterior region of the mouth; and wherein said at least one distal tuft comprises a tooth contact surface having oblique angulation in opposite directions, said oblique angulation comprising an upwardly facing point; and where said toothbrush being for cleaning interproximally beneath the spanning archwire, and the mesial and distal tooth and bracket or band surfaces, in the anterior and posterior regions of the mouth; and wherein the height of said shortest-bristle inner tuft rows represents the average protrusive depth of the thickness of each bracket protruding from each tooth surface; and wherein at the distal end of the bristle head said tallest bristles are used to clean from around each coronal crown end of each tooth to each apical gum end of each tooth at the rear posterior portions of the mouth.

2. The orthodontic toothbrush as in claim 1 further comprising a friction inducing gripping surface along the handle.

3. The orthodontic toothbrush as in claim 1 wherein said toothbrush head is removable and replaceable by a conventional toothbrush head.

4. The orthodontic toothbrush as in claim 3 wherein said handle is joinable to said bristle head, wherein said handle includes an insertion member insertable within a socket within said bristle head.

5. The orthodontic toothbrush as in claim 4 wherein said bristle head includes at least one mating surface engageable with a corresponding mating surface of said handle.

6. The orthodontic toothbrush as in claim 1 wherein said toothbrush head is rotatable to a position from zero to about forty five degrees off of its longitudinal axis.

7. The orthodontic toothbrush as in claim 1 further comprising an interchangeable conical tooth stimulator member at a proximal end of said handle which said proximal end is opposite to a distal and of said toothbrush head.

8. The orthodontic toothbrush as in claim 7 wherein said interchangeable conical tooth stimulator member is a group of bristles.

9. The orthodontic toothbrush as in claim 7 wherein said interchangeable conical tooth stimulator member is a flexible solid member.

10. The orthodontic toothbrush as in claim 1 wherein said toothbrush head is removable and replaceable by a conventional toothbrush head.

11. The orthodontic toothbrush as in claim 10 further comprising an interchangeable conical tooth stimulator member at a proximal end of said handle which said proximal end is opposite to a distal end of said toothbrush head.

12. The orthodontic toothbrush as in claim 11 wherein said interchangeable conical tooth stimulator member is a group of bristles.

13. The orthodontic toothbrush as in claim 11 wherein said interchaneable conical tooth stimulator member is a flexible solid member.

14. The orthodontic toothbrush as in claim 10 wherein said handle is joinable to said bristle head, wherein said handle includes an insertion member insertable within a socket within said bristle head.

15. The orthodontic toothbrush as in claim 10 wherein said bristle head includes at least one mating surface engageable with a corresponding mating surface of said handle.

16. The orthodontic toothbrush as in claim 1 wherein said toothbrush head is rotatable to a position from zero to about forty five degrees off of its longitudinal axis.

* * * * *